United States Patent [19]

Shinohara et al.

[11] 4,039,084

[45] Aug. 2, 1977

[54] SAFETY-GUARD FOR A CRANE

[75] Inventors: Shinitsu Shinohara, Takamatsu; Hisanori Uchino, Tokyo; Hiroyuki Yamaji, Kagawa, all of Japan

[73] Assignee: Tadano Ironworks Co., Ltd., Takamatsu, Japan

[21] Appl. No.: 266,355

[22] Filed: June 26, 1972

[30] Foreign Application Priority Data

July 6, 1971 Japan ..... 46-49241
Sept. 13, 1971 Japan ..... 46-83664[U]

[51] Int. Cl.[2] ..... B66C 13/48

[52] U.S. Cl. ..... 212/39 MS; 73/141 A; 177/146; 177/211

[58] Field of Search ..... 212/39; 340/267 C; 177/211, 146, 147; 235/151.33; 73/141 A

[56] References Cited

U.S. PATENT DOCUMENTS

| | | | |
|---|---|---|---|
| 2,477,854 | 8/1949 | Baker | 73/141 A X |
| 2,616,683 | 11/1952 | Le Fevre | 177/211 |
| 2,761,670 | 9/1956 | Fouretier | 177/211 |
| 2,765,654 | 10/1956 | Greer et al. | 177/147 X |
| 3,339,652 | 9/1967 | Price | 177/147 X |
| 3,489,294 | 1/1970 | Greb et al. | 212/39 R |
| 3,618,064 | 11/1971 | Hamilton | 340/267 C |
| 3,641,551 | 2/1972 | Sterner et al. | 212/39 R X |
| 3,724,679 | 4/1973 | Brownell et al. | 212/39 MS |
| 3,740,534 | 6/1973 | Kezer et al. | 212/39 A X |
| 3,909,817 | 9/1975 | Pietsch et al. | 340/267 C |

FOREIGN PATENT DOCUMENTS

| | | | |
|---|---|---|---|
| 1,268,340 | 5/1968 | Germany | 212/39 R |

*Primary Examiner*—Evon C. Blunk
*Assistant Examiner*—James L. Rowland

[57] ABSTRACT

A safety-guard for a crane having a boom, comprising stress-detecting means which is provided to lifting hydraulic cylinder unit for the boom so as to detect a stress applied to the cylinder unit in the direction along the axis of said unit and to give out a signal, one or more functional potentiometers which correspond to respective spans of the boom and give out safety-limit stress-reduced signals at the concerned span of the boom respectively with the movement of movable contacts that are moved in response to the vertical revolution of the boom, and a safety device which receives said signals coming from the stress-detecting means and one of the functional potentiometers corresponding to the concerned span of the boom and indicates the concerned ratio of operation of the crane or gives a warning on falling-down and/or breaking-down of the crane. Thus, operator can catch operation state of the crane with ease for a safe operation of the crane.

6 Claims, 12 Drawing Figures

SAFETY-GUARD FOR A CRANE

This invention relates to a safety-guard for a crane, and more particulary to a safety-guard for a crane having a boom wherein there is provided a safety device which indicates the concerned relation between the concerned ratio of operation and safety-limit or stopps an operation increasing the moment applied to the boom automatically at such safety-limit so that operator may forecast the danger of falling-down and/or breaking-down of the crane due to the moment applied to the boom for the purpose of the safe operation of the crane.

In a crane installed on a truck or on the earth, there are two kinds of safety-limit. That is, one kind of safety-limit is concerned with the mechanical breaking-down of the crane dependent on the structure of the crane and the other kind of safety-limit is concerned with the falling-down of the crane. The latter safety-limit of falling-down depends, when the crane-boom is installed on a base with an installing condition, on three factors, that is, the span of the crane-boom, upwardly revolving or lift angle of said boom and the load including the empty load of the boom. In a practical operation of a crane, work or operation radius R of the crane is usually employed for calculating the safety-limit of operation. Said work or operation radius R is the horizontal distance between the center of base body of the crane and the load carried by the crane-boom and is represented approximately by the following formula:

$$R = l \cos \theta - A,$$

where $l$ is the span of the boom, $\theta$ is lift angle of the boom, and $A$ is a constant determined by the center of the base body and the revolving center of the crane-boom. These three factors are mutually related to one another in a practical operation of the crane and there is a safety-limit for preventing the falling-down of the crane which limit is determined under mutual relations among these three factors.

In a conventional operation of a crane, the crane is usually operated within the safety-limit of operation by making reference to so-called a characteristic curve or a capacity diagram in which mutual relations among said three factors are represented. However, when a crane is operated by making reference one by one to such a graph or diagram, the rate of operation of the crane is apt to become lowered and the mental fatigue of operator is large. Under the above-mentioned circumstances, there have been proposed several kinds of safety-guards for a crane by which guard said three factors are measured or detected, relations among these factors are calculated and indicated so as to give a warning to operator. The safety-guards for a crane according to the prior art, however, are ones for a crane with a boom of smaller empty load or for a crane with a non-extensible boom. In addition, almost all of the safety-guards according to the prior art indicate only the relation between lift angle of the boom and load carried by the boom and further can hardly be employed in a practical use due to the failure of mechanical strength, durability or the like.

Further, there have increasingly been used recently cranes with boom members which are extended and contracted by hydraulic cylinder units arranged between two adjacent boom members. A crane of said type has a boom with larger empty load and the span of said boom can be varied by extending or contracting extensible boom members telescopically. In operating such a crane, it is required to grasp exactly the aforementioned three factors influencing the falling-down of the crane and to operate the crane under consideration of relations among said factors.

Accordingly, a primary object of the present invention is to provide a safety-guard of a crane with a boom having telescopically extensible boom members or only a non-extensible boom member which guard gives a faithful and reliable indication of a ratio of operation to safety-limit of operation of the crane.

Another object of the present invention is to provide a safety-guard for a crane of the aforestated type which guard lessens the fatigue of crane-operator owing to an automatical warning of a danger of the falling-down and/or breaking-down of the crane.

A still another object of the present invention is to provide a safety-guard for a crane of the aforestated type which guard is simple in construction and rich in durability.

The present invention and its attendant advantages will become more readily apparent as the specification is considered in conjunction with the accompanying drawings in which.

Figure 1:
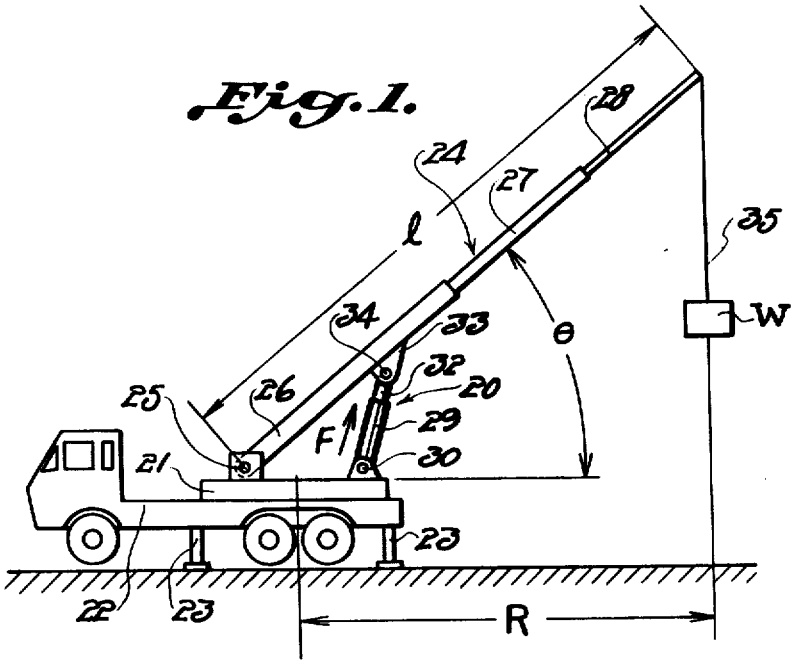
FIG. 1 is an elevational side view of a crane with three-stage extensible boom and installed on a truck in which crane an embodiment of the safety-guard according to the present invention is employed.

Referring now to the drawings, wherein like numerals designate like parts throughout the various figures thereof, there is shown a crane with a boom having telescopically extensible boom members in FIG. 1. The base body 21 of said crane is installed on a truck 22 in such a manner that the crane may be revolved horizontally by 360°. In operating the crane, the truck 22 is lifted by four supporting legs 23 together with the base body 21 with keeping the ground plane of the body 21 horizontal. On the base body 21 is mounted a three-stage extensible boom 24 which may be revolved upwardly and downwardly about a horizontally arranged supporting shaft 25 mounted on the body 21. Said boom 24 has a non-extensible base boom member 26 and two telescopically extensible boom members 27 and 28 which may be extended and contracted, as is usual, by respective hydraulic cylinder units (not shown) arranged in the boom between said respective two adjacent boom members, so that the span $l$ of the boom 24 can be changed variously.

The boom 24 is lifted or moved in the vertical direction about the shaft 25 by a lifting hydraulic cylinder unit 20 the cylinder 29 of which unit is pivotally connected to the base body 21 by a pin 30 at the bottom end thereof and the piston-rod 32 of which unit is pivotally connected to a bracket 33 secured to the lowermost boom member 26 by a pin 34 at the top end thereof, so that lift angle $\theta$ of the boom 24 can be changed variously by the extending and contracting operation of the piston-rod 32 in the cylinder unit 20. As is usual, a load W is hung or carried by the boom 24 with a wire-rope 35.

Figure 2:
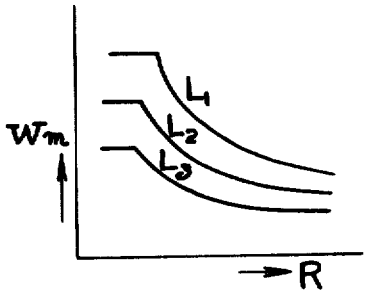
FIG. 2 is a characteristic curve of the crane shown in FIG. 1 representing the relation between work or operation radius of the crane and safety-limit load carried by the boom of said crane.
Figure 3:
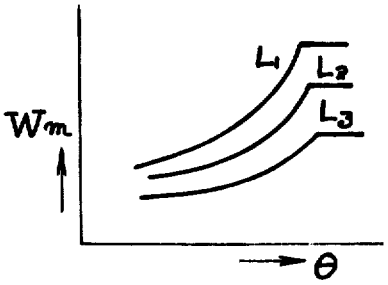
FIG. 3 is an another characteristic curve of the crane shown in FIG. 1 representing the relation between lift angle of the boom and safety-limit load carried by said boom.

As stated before, in a crane with extensible boom such as the one shown in FIG. 1, span $l$ of the boom, lift angle $\theta$ of the boom and load W carried by the boom are mutually related in operation in connection with the falling-down and breaking-down of the crane. So, in usual, safety-limit of such crane is designated by a characteristic diagram or curve which represents relations among said three factors. In this case, for the convenience of practical working, work or operation radius R shown in FIG. 1 is employed in place of lift angle $\theta$. In FIGS. 2 and 3, two kinds of characteristic curves, by way of example, of the crane shown in FIG. 1 are shown. In FIGS. 2 and 3, Curves $L_1$, $L_2$ or $L_3$ represent respective safety-limit loads Wm in such cases when the boom 24 is in fully contracted state or the second or third boom members 27 or 28 are in fully extended state respectively, and FIGS. 2 or 3 represent respectively the relations between work or operation radius R and such safety-limit load W$m$ or between lift angle $\theta$ of the boom and such safety-limit load W$m$. Of course, said safety-limit load W$m$ shown by these characteristic curves should be determined from the view-points of breaking-down and also falling-down of the crane. The crane is operated safely when load W is below safety-limit load W$m$ at a work radius R or lift angle $\theta$ at concerned length $l$ of the boom.

Figure 11:
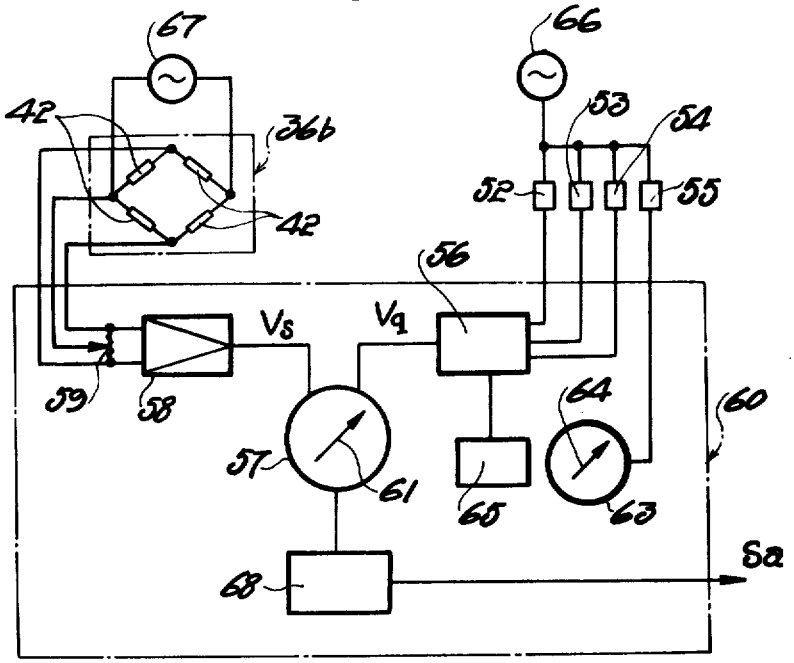
FIG. 11 is a schematic diagram of an embodiment of the safety-guard according to the present invention.
Figure 12:
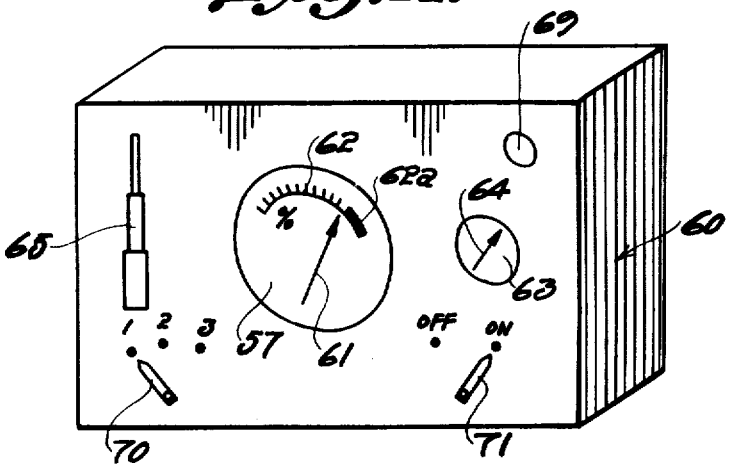
FIG. 12 is a perspective view of guard box employed in the safety-guard shown in FIG. 11.

According to the present invention, in place of detecting or measuring each of said three factors individually and comparing detected or measured factors with characteristic curves shown, a stress F, which is applied to the hydraulic cylinder unit 20 along the axis of said unit as shown in FIG. 1 and is varied with changes in the moment applied to the boom 24, is detected, said stress is compared with previously obtained safety-limit stress at concerned span $l$ of the extensible boom 24 and lift angle $\theta$ of said boom, and in the guard of the present embodiment, the ratio between said actually applied stress and the safety-limit stress is indicated for warning, as will be detailed later with reference to FIGS. 11 and 12.

Figure 4:
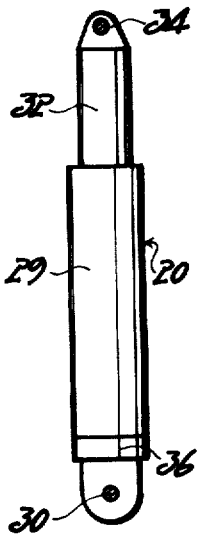
FIG. 4 is an enlarged elevational view of lifting hydraulic cylinder unit for the boom possibly employed in the crane shown in FIG. 1 showing an embodiment of the arrangement of stress-detecting means which is employed in the safety-guard according to the present invention.

In FIG. 4, there is shown one embodiment of means for detecting stress F applied to the lifting hydraulic cylinder unit 20 in the direction along the axis thereof during the operation of the crane. The stress-detecting means 36 shown in FIG. 4 is composed of strain gauges or the like and is arranged between the bottom of the cylinder 29 and the supporting pin 30.

Figure 5:
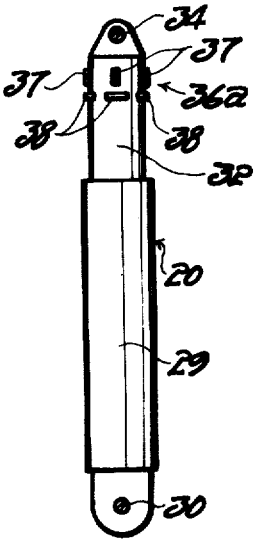
FIG. 5 is an enlarged elevational view of an another lifting hydraulic cylinder unit for the boom possibly employed in the crane shown in FIG. 1 showing an another embodiment of the arrangement of stress-detecting means which is employed in the safety-guard according to the present invention.

In FIG. 5, there is shown an another arrangement of such stress-detecting means 36$a$ which also detects said stress F. The stress-detecting means 36$a$ shown in FIG. 5 is composed of four pairs of strain guages 37 and 38 attached to the periphery of the piston-rod 32 with intervals of 90° therebetween. The strain guages 37 detect strain of the piston-rod 32 along the axis of the cylinder unit 20 and the strain guages 38 detect strain of the piston-rod 32 in the direction perpendicular to said axis of the unit 29 for correcting the deviation of the former strain due to Poisson's ratio and change in ambient temperature. The device 36$a$ composed of thus combinated strain guages 37 and 38 gives an exact and reliable measure of the stress F.

Figure 6:
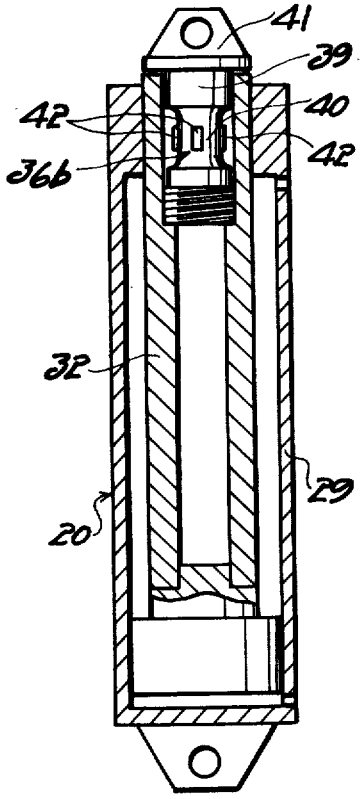
FIG. 6 is an enlarged sectional view of a still another lifting hydraulic cylinder unit for the boom possibly employed in the crane shown in FIG. 1 showing a still another embodiment of the arrangement of stress-detecting means which is employed in the safety-guard according to the present invention.
Figure 7:
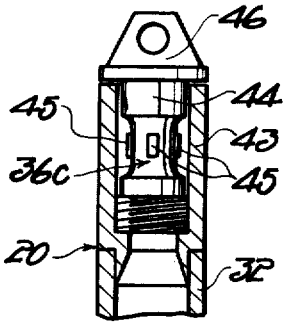
FIG. 7 is an enlarged sectional view of a part of piston-rod in a further lifting hydraulic cylinder unit for the boom possibly employed in the crane shown in FIG. 1 showing a further embodiment of the arrangement of stress-detecting means which is employed in the safety-guard according to the present invention.
Figure 8:
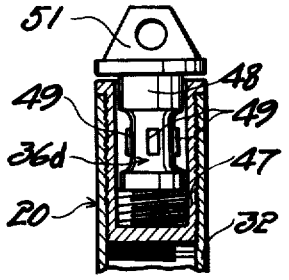
FIG. 8 is an enlarged sectional view of a part of piston-rod in a still further lifting hydraulic cylinder unit for the boom possibly employed in the crane shown in FIG. 1 showing a still further embodiment of the arrangement of stress-detecting means which is employed in the safety-guard according to the present invention.

Turning now to FIGS. 6, 7 and 8, there are shown more preferred embodiments of the stress-detecting means according to the present invention, wherein the detecting means is attached to a supporting means inserted into the piston-rod 32 of the unit 20 for preventing the reduction of effective stroke of the rod 32.

The piston-rod 32 shown in FIG. 6 is formed into a hollow one having an opening at the top. Into the hollow space in the rod 32 is inserted and screwed a supporting means 39 which has a narrowed neck 40 and a top bracket 41 projecting outwardly from the free end of the rod 32. Four strain guages 42 composing a stress-detecting means 36$b$ are attached to the periphery of the supporting means 39 at the neck 40 thereof and said means 39, which forms now a top portion of the piston-rod 32, is connected to the boom member 26 at the top bracket 41.

In the arrangement of the stress-detecting means 36$c$ shown in FIG. 7, a cylindrical attachment 43 having a same diameter with the one of the rod 32 is welded on the top of said rod and a supporting means 44 is inserted into and screwed to said attachment 43. Strain guages 45 composing the means 36$c$ are attached to the periphery of the supporting means 44 at the narrowed neck thereof and top bracket 46 of said means 44 projecting upwardly from the attachment is connected to the lowermost boom member 26, whereby the piston-rod 32 is operatively connected to the boom 24 through the attachment 43 and the supporting means 44.

In the embodiment shown in FIG. 8, a cylindrical attachment 47 is screwed into the hollow piston-rod 32 and a supporting means 48 is screwed into said cylindrical attachment 47. The stress-detecting means 36d composed of strain guages 49 is provided on the narrowed neck of the supporting means and said means 48 is connected to the boom member 26 at the top bracket 51 projecting outwardly from the attachment 47, thus the piston-rod 32 being operatively connected to the boom.

Each of the stress-detecting means 36b, 36c and 36d shown in FIGS. 6, 7 and 8 never enlarges the lifting hydraulic cylinder unit 29 because such the provision of the detecting means never shortens the cylinder unit itself or the stroke of the piston-rod 32. In addition, the means 36b, 36c and 36d are effectively protected from the damage by the surrounding walls.

Figure 9:
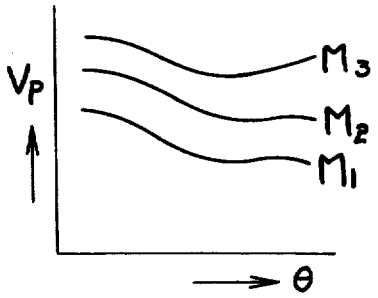
FIG. 9 is a characteristic curve of stress applied to the lifting hydraulic cylinder unit along the axis of said unit shown in FIG. 1 showing the relation between lift angle of the boom and output signal of the stress-detecting device.

Each of the stress-detecting means 36, 36a, 36b, 36c and 36d is formed, according to the present invention, into such that gives out an electric signal in response to the detected stress F which is varied by the moment applied to the boom 24. Such a stress-detecting means itself is well known to the art. In FIG. 9, there is shown an example of the relation between lift angle $\theta$ of the boom 24 and safety-limit output signal $Vp$ of the stress-detecting means 36, 36a, 36b, 36c or 36d, which signal $Vp$ corresponds to safety-limit stress applied to the cylinder unit 20 in the direction of the axis of said unit due to the moment applied to the boom 24. In said figure, curves $M_1$, $M_2$ or $M_3$ represent respective safety-limit output signal $Vp$ in such cases when the boom 24 is fully contracted or the second or third boom members 27 or 28 are fully extended respectively.

Figure 10:
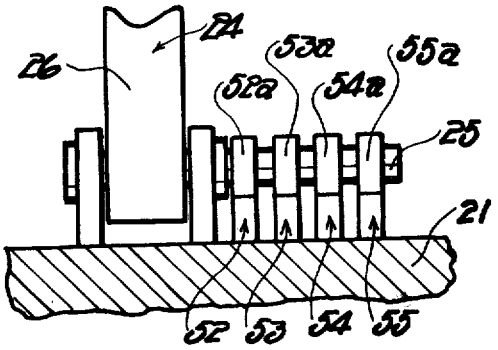
FIG. 10 is an enlarged front view of a part of the crane shown in FIG. 1 showing an embodiment of the arrangement of functional potentiometers employed in the safety-guard according to the present invention.

In FIG. 10, there is shown an embodiment of the arrangement of functional potentiometers 52, 53 and 54 and a further functional potentiometer 55 provided according to the present invention. In the embodiment shown, movable contacts 52a, 53a, 54a and 55a of the potentiometers 52, 53, 54 and 55 are fixedly mounted on the aforementioned shaft 25 at the lower end of the boom 24 so that said contacts 52a to {a are moved synchronously with the vertically revolving movement of the boom 24, whereby each position of the contacts 52a to 55a corresponds to each lift angle $\theta$ of the boom. Further, according to the present invention, each of the functional potentiometers 52, 53 and 54 is so preset that said each potentiometer gives out in response to the movement of the movable contact 52a, 53a or 54a an electric signal corresponding to the stress-reduced or converted value of the safety-limit movement at each lift angle $\theta$ of the corresponding boom members 26, 27 or 28 in the fully extended state of said member. That is, the functional potentiometers 52, 53 and 54, which corresponds to the boom members 26, 27 and 28 respectively, give out electric signals $Vp$ represented respectively by curves $M_1$, $M_2$ and $M_3$ of FIG. 9 in response to the movement or displacement of the contacts 52a, 53a and 54a, respectively.

Now, an embodiment of the safety-guard for a crane according to the present invention is detailed with reference to the schematic diagram shown in FIG. 11. As shown in said figure, the functional potentiometers 52, 53 and 54 are connected to a selecting device 56 by which one of the output signals of the functional potentiometers 52, 53 and 54 is derived selectively in correspondence to the concerned extended state of the boom members 26, 27 or 28 by a manual or automatical selection. Said device 56 is connected to an indicating or safety device 57 so that output reference signal $Vq$ is sent to the safety device 57 from the selecting device 56.

The stress-detecting means 36b employed in the arrangement shown in FIG. 11 is such that is shown in FIG. 6 and the four strain guages 42 are in a bridge-connection as shown, and the output terminals of the same is connected to an amplifier 58 through zero-adjusting resistor 59. The amplifier 58 is then connected to the safety device 57 so that the output signal $Vs$ of the detecting means 36b is sent to said indicating device 57.

Thus, the safety device 57 receives an electric signal $Vq$ which corresponds to safety-limit stress in fully contracted state of the boom 24 or in each fully extended state of respective boom members 27 or 28 and an electric signal $Vs$ which corresponds to actually applied stress in said state. According to the preferred embodiment of the present invention, the safety device 57 is so constructed that the device calculates the ratio of the signal $Vs$ coming from the stress-detecting means to the signal $Vq$ coming from one of the functional potentiometers 52, 53 or 54 through the selecting device 56, and said ratio is indicated by the safety device 57. The appearance of said device 57 is shown in FIG. 12. That is, the device 57 is accomodated in a watching or guard box 60 provided near the operator's seat and the indicating face of said device 57 may be viewed through a widow, so that operator can catch said ratio in percentage by watching the position of a pointer 61 along a scale 62. According to a further preferred embodiment of the present invention, the scale 62 has a marked zone 62a, for example a zone colored in red, which represents dangerous zone and the crane will fall down or be damaged when the pointer 61 enters said zone.

In this case, because the signal $Vq$ coming from the selecting device 56 corresponds to safety-limit stress value at the concerned lift angle $\theta$ of the boom, the safety device 57 displays the ratio of 100% in case of $Vs = Vq$ representing just safety-limit of the crane, and the device 57 displays the ratio below 100% or above 100% in case of $Vs < Vq$ or $Vs > Vq$ representing safe operation or dangerous operation of the crane. In a practical case, such safety-limit value is predetermined a little lower than the value at which really causes the falling-down or breaking-down of the crane. So, even when the value of signal $Vs$ exceeds the value of signal $Vq$ a little, the crane does not fall down or is not broken down immediately and operator may correct the operation of the crane so as to lower the ratio of $Vs$ to $Vq$ when the device 57 has displayed a ratio above 100%.

Turning again to a consideration of FIG. 11, there is connected to the fourth functional potentiometer 55 a lift-angle indicator 63 which is also accomodated in the watch box 60 and displays lift angle by the displacement of a pointer 64 through another window of the box 60, as shown in FIG. 12. Further, there is connected to the selecting device 56 an indicator 65 which indicates the extended state of the boom 24, as shown in FIG. 12. In addition, the input terminals of the functional potentiometers 52 to 55 are connected to a common power source 66 and the input terminals of the stress-detecting means 36b are connected to a power source 67.

According to a preferred embodiment of the present invention, the safety device 57 is combinated with an alarming circuit or device 68 which gives out an alarm signal $Sa$ such as alarming sound when the ratio of $Vs$ to $Vq$ exceeds a predetermined limit value, as shown in FIG. 11. Further, as shown in FIG. 12 an alarm light 69, which is lightened by receiving said alarm signal from the device 68 may be provided. According to another preferred embodiment of the present invention, the safety device 57 or the alarming device 68 may be formed or into such that prevents at least one of the lifting hydraulic cylinder unit 20, hydraulic cylinder units for extending and contracting the boom members 27 and 28 and winch for the load W from operating to increase the moment applied to the boom 24 when a relation between the signals $Vs$ and $Vq$ such as ratio of $Vs$ to $Vq$ reaches a predetermined one.

In the embodiment shown in FIGS. 11 and 12, the parts of safety guard enclosed by a dotted line 60 in FIG. 11 are arranged in the watch box 60 and the selecting device 56 is operated manually by handling a knob 70 shown in FIG. 12. The connection of the functional potentiometers 52 to 55 and the detecting means **36*b* to respective power sources 66 and 67 is made by a switch knob 71 shown in FIG. 12. In addition, for a previous examination on the correct operation of the parts in the box 60** before operating the crane, a suitable self-checking circuit such as so-called BITEcircuit may be provided in the box so that said examination can be made by pushing a button.

As detailed in the above, the safety-guard for a crane shown always displays a ratio of operation to safety-limit operation so that operator need not keep his mind on a complicated reference of measured lift angle of the boom, span of the boom and load carried by the crane to a characteristic diagram or curve of said crane and may operate the crane without any anxiety. This, of course, contributes to the increase in operation efficiency of the crane.

Although only one preferred embodiment of the safety-guard according to the present invention is illustrated, by way of example, in the drawings and particularly described, the safety-guard shown may be changed in construction variously within the scope of the spirit of the present invention. The following are some examples of such changes in construction. First, the relation between the output signal $Vs$ coming from the stress-detecting means **36*b* and the output signal $Vq$ coming from the selecting device 56 may be displayed on the safetydevice 57** in such a manner that said two kinds of output signals stand a parallel row. In this case, top, the ratio of the concerned operation may be recognized with ease.

Next, the safety-guard according to the present invention may also, of course, be employed in a crane having a non-extensible boom. In this case, the selecting device 56 may be omitted because, in this case, there is provided only one functional potentiometer which corresponds to the invariable span of said non-extensible boom.

Further, in case of a crane having an extensible boom, too, there may be provided only one functional potentiometer of said type which corresponds to the span in fully extended state of said telescopically extensible boom. Said potentiometer contributes to a safe operation of the crane when the crane is operated under the most dangerous or serious condition, that is, with the largest span of the boom. In this case, too, the selecting device 56 may be omitted.

Furthermore, in case of a crane having two or more extensible boom members, there may be provided two or more functional potentiometers of said type which correspond to respective spans in fully extended states of said exensible boom members, because there is little fear of falling-down or breaking-down of the crane when the crane is operated under a condition where the boom is fully contracted, that is, only with the span of the base non-extensible boom member.

In a further embodiment of the safety-guard according to the present invention, functional potentiometers more than the numbers of boom members may be provided. That is, for example in the embodiment illustrated, there may be provided further two functional potentiometers of said type one of which corresponds to a span of the boom 24 in case where the second boom member 27 is extended half and the other of which corresponds to a span of the boom 24 in case where the third boom member 27 is extended half. Thus, by providing one or more further functional potentiometers which correspond respective spans on the way of the extension of respective extensible boom members, actual state of operation of a crane may be caught more accurately.

In addition, there is known a crane having a pair of lifting hydraulic cylinder units for the boom which units are operated synchroneously. In such a crane, the stress-detecting means may be provided to one or both of said cylinder units. In practice, said pair of cylinder units are so formed or designed that almost equal stresses are applied to both of them.

The provision of stress-detecting means to the lifting hydraulic cylinder unit for the boom according to the present invention gives the following advantages. That is, in case when the stress-detecting means is provided to the base body 21 or the like, stress detected by said detecting means is varied variously even at cranes of same type because the shape and size of such base body or the like is changed variously due to the difficulty in manufacturing or processing the same with a high accuracy and such change in the shape and size causes the change in stress detected by stress-detecing means on such base body or the like. In contrast to the above, a piston-rod or cylinder of lifting hydraulic cylinder unit for the boom may be finished with a high accuracy owing to circular cross-section of the same. Accordingly, when three supporting points or positions 25, 30 and 34 of the crane shown in FIG. 1 are determined or set precisely, there is always detected by stress-detecting means provided to said cylinder unit an almost identical value of stress which is common to cranes of same type in corresponding operation state. Thus, the value of safety-limit sress which is to be preset on the functional potentiometers is identical in cranes of same type, that facilitates mass-production of the safety-guard including such functional potentiometers.

Having now described the invention and having exemplified the manner in which it can be carried into practice, it is apparent to those skilled in the art that innumerable variations, applications, modifications and extensions of the basis principles involved may be made without departing from the spirit of the invention. The invention is to be limited, therefore, only by the scope of the appended claims.

What is claimed is:

1. In a crane having a base, a boom pivotally mounted on the base so that the lift angle thereof may be varied, and at least one hydraulic cylinder unit connected to the base and the boom for varying the lift angle of the boom, the hydraulic cylinder unit comprising a cylinder, a piston slidably inserted in the cylinder in a fluid-tight manner, and piston rod connected to the piston at one end thereof and projected outwardly from the cylinder and having a hollow end, a safety guard comprising:

a. support means secured to the piston rod within said hollow end thereof for supporting stress-detecting means, b. stress-detecting means for detecting stress in the axial direction of the cylinder unit by the moment applied to the boom by the weight of the boom and a load carried by the boom, the stress-detecting means including at least one strain-detecting gauge fixedly mounted within said piston rod on said support means, the stress-detecting means providing an electrical output signal corresponding to the stress in response to strain of said support means detected by the gauge, c. safety-limit signal generating means for generating an electrical signal which corresponds to a predetermined maximum allowable moment applied to the boom, and d. safety means for receiving the electrical output signal from the stress-detecting means and the electrical signal from the safety-limit signal generating means and for determining a relationship therebetween.

2. The structure of claim 1 in which said support means comprises a spool-shaped member threadedly engaged with the piston rod.

3. The structure of claim 1 in which said support means includes a free end which projects outwardly from the hollow end of said piston rod and a bracket for connecting the cylinder unit to the boom secured to the free end of the support means.

4. The structure of claim 1 in which said piston rod includes a first portion and a hollow cylindrical attachment secured to said first portion, said hollow end of the piston rod being formed by the cylindrical attachment.

5. The structure of claim 4 in which said cylindrical attachment has an outer diameter equal to that of said first portion of the piston rod, the attachment being secured to the free end of said first portion.

6. The structure of claim 5 in which said first portion of the piston rod comprises a free hollow end, said hollow cylindrical attachment being located within such free hollow end.

* * * * *